US009093786B2

(12) United States Patent
Forell et al.

(10) Patent No.: US 9,093,786 B2
(45) Date of Patent: Jul. 28, 2015

(54) ELECTRICAL CONNECTOR HAVING A LEVER MATING ASSIST WITH BLOCKING SYSTEM

(75) Inventors: Richard Forell, Lorsch (DE); Marcel Schmitt, Gorxheimertal (DE)

(73) Assignee: Tyco Electronics AMP GmbH, Bensheim (DE)

( * ) Notice: Subject to any disclaimer, the term of this patent is extended or adjusted under 35 U.S.C. 154(b) by 264 days.

(21) Appl. No.: 13/818,300

(22) PCT Filed: Aug. 9, 2011

(86) PCT No.: PCT/EP2011/063696

§ 371 (c)(1),
(2), (4) Date: Jun. 5, 2013

(87) PCT Pub. No.: WO2012/025376

PCT Pub. Date: Mar. 1, 2013

(65) Prior Publication Data

US 2013/0252446 A1 Sep. 26, 2013

(30) Foreign Application Priority Data

Aug. 24, 2010 (DE) ..... 10 2010 039 706

(51) Int. Cl.
*H01R 13/62* (2006.01)
*H01R 13/629* (2006.01)

(52) U.S. Cl.
CPC ..... *H01R 13/629* (2013.01); *H01R 13/62938* (2013.01); *H01R 13/62955* (2013.01)

(58) Field of Classification Search
CPC ..... H01R 13/629; H01R 13/62938; H01R 13/62955
USPC ..... 439/157, 372, 160
See application file for complete search history.

(56) References Cited

U.S. PATENT DOCUMENTS 5,476,390 A 12/1995 Taguchi et al.
6,540,532 B1 * 4/2003 Martin et al. ..... 439/157

(Continued)

FOREIGN PATENT DOCUMENTS

DE 69924430 T2 2/2006
GB 2293053 A 3/1996

(Continued)

OTHER PUBLICATIONS

International Preliminary Report on Patentability issued by the International Bureau of WIPO, Geneva, Switzerland, dated Feb. 26, 2013, for related International Application No. PCT/EP2011/063696; 8 pages.

(Continued)

*Primary Examiner* — Javaid Nasri
(74) *Attorney, Agent, or Firm* — Faegre Baker Daniels LLP

(57) ABSTRACT

An electrical plug-in connector with a casing, with a lever rotatably mounted on the casing. The lever has a guideway provided for guiding a guide element of a second casing, with the guide element being guided in the guideway upon rotation of the lever and the second casing being pulled from a pre-assembly position with regard to the casing into an end position. The casing has a flexible blocking element, an insertion space for introducing the guide element into the guideway being provided, the blocking element having an actuating surface, the actuating surface in a rest position of the blocking element projecting into the insertion space. The lever has a blocking surface, the blocking element having a second blocking surface, with, in a rest position of the lever and in a rest position of the blocking element, the second blocking surface of the blocking element being associated with the blocking surface of the lever and blocking a movement of the lever from the rest position into an end position.

10 Claims, 13 Drawing Sheets

(56) References Cited

U.S. PATENT DOCUMENTS

| | | | |
|---|---|---|---|
| 7,044,758 | B2 | 5/2006 | Deno et al. |
| 2006/0051994 | A1 | 3/2006 | Fujii |

FOREIGN PATENT DOCUMENTS

| | | | |
|---|---|---|---|
| JP | 2003264036 | A | 9/2003 |
| WO | WO 2007/146130 | A2 | 12/2007 |

OTHER PUBLICATIONS

International Search Report and Written Opinion issued by the European Patent Office, dated Oct. 7, 2011, for related International Application No. PCT/EP2011/063696; 12 pages.

Examination Report dated Mar. 23, 2011, issued by the German Patent and Trademark Office for related Application No. 10 2010 039 706.7; 5 pages.

* cited by examiner

ELECTRICAL CONNECTOR HAVING A LEVER MATING ASSIST WITH BLOCKING SYSTEM

FIELD OF THE INVENTION

The invention relates to an electrical plug-in connector.

BACKGROUND OF THE INVENTION

Various embodiments of electrical plug-in connectors are known from the prior art. Electrical plug-in connectors have for example a first and a second contact casing with contacts, the two contact casings being able to be pulled by means of a pivotable stirrup part from a pre-assembly position into an end position. In such case, the stirrup part is rotatably mounted on the first casing, and the second casing has a blocking element which releases pivoting of the stirrup part from the pre-assembly position into the end position only once the two casings are in the pre-assembly position, as described in U.S. Pat. No. 6,540,532 B1.

SUMMARY OF THE INVENTION

The object of the invention is to provide an improved electrical plug-in connector.

The object of the invention is achieved by the plug-in connector in accordance with the claims.

Further advantageous embodiments of the plug-in connector are set forth in the dependent claims.

One advantage of the plug-in connector is that a blocking element is provided which projects with an actuating section into an insertion space which is provided for supplying a guide element of a second casing to a guideway of the lever. Upon fitting the two casings together in a pre-assembly position, the guide element pushes the blocking element into a release position in which movement of the lever is released. The actuating section is formed such that upon introduction of the guide element into the guideway the actuating section is deflected such that the lever can be moved from a blocked pre-assembly position into the end position. In this manner, secure blocking of the lever is possible. In addition, the guide elements serve not only for guiding the second casing in the guideway of the casing, but also as actuating means for deflecting the blocking element. Thus it is not necessary to form a further actuating element. Using the guide element to actuate the blocking element allows precise release, which means that the guide element specifies the position of the second casing with regard to the casing more precisely than an edge region. It is thus ensured that the lever is actually only released when the second casing and the casing are in a pre-assembly position.

In one embodiment, the lever is arranged between the blocking element and an inner region of the casing, and the insertion space is arranged between the lever and the inner region of the casing. This makes possible accurate and reliable guidance of the guide elements with the lever with a small structural form.

In a further embodiment, the flexible blocking element is formed as part of a casing wall of the casing. Thus a simple construction of the plug-in connector is achieved.

In a further embodiment, the blocking element has an actuating surface which projects into the guide track and is arranged in inclined manner to the direction of movement of the guide element. The actuating surface supports deflection of the blocking element in the direction of the flexible element and hence to releasing the lever. In this manner, a low force with low mechanical stress on the blocking element is sufficient to move the blocking element into a release position.

In a further embodiment, the lever has a latch recess and the blocking surface of the lever is formed on an inner side of the latch recess. The provision of the latch recess makes secure blocking of the lever with the aid of the blocking element possible. In this manner, the lever can be blocked in the two pivoting directions with the aid of the blocking element.

In a further embodiment, a safety catch is provided on the contact casing, which catch can be moved into a blocking position, the safety catch in the blocking position securely holding a lever arm of the lever in an end position. In this manner, secure fixing of the lever in the end position is achieved with the aid of simple means.

In a further embodiment, the safety catch is displaceably mounted on the contact casing via a sliding guide and has a blocking element which securely holds the safety catch in an end position.

In a further embodiment, a casing wall of the contact casing has on the inner side a first guide contour in the form of a partial circle. The lever has on an outer side a second guide contour in the form of a partial circle. The first and the second guide contour are associated with each other, the first guide contour upon pivoting of the lever guiding the second guide contour on at least one partial circular path. In this manner, stable and secure guidance of the lever upon the pivoting operation is achieved. This reduces the stress on the bearing of the lever.

In a further embodiment, the lever has on an outer side a recess in which the blocking element is received upon the movement of the lever from the latching position into the end position. In this manner, it is possible for the blocking element, once the lever has been released and once the lever has moved in the direction of the end position, to be able to pivot back into a non-deflected state. This minimises the mechanical stress on the blocking element upon the deflection. The deflected state of the blocking element is only briefly necessary for releasing the lever. The recess additionally reduces the installation space for the plug-in connector.

In a further embodiment, the blocking element, adjoining the actuating section, has a sliding surface arranged in inclined manner, the sliding surface being arranged inclined such that in the release position of the blocking element the sliding surface faces the blocking surface of the lever and the blocking surface of the lever can slide across the sliding surface with low force and pushes the blocking element further away from the blocking surface. This reduces the force required for pivoting the lever out of the blocking position into the end position.

BRIEF DESCRIPTION OF THE DRAWINGS

The invention will be explained in greater detail below with reference to the figures.

These show.

DETAILED DESCRIPTION OF THE INVENTION

Figure 1:
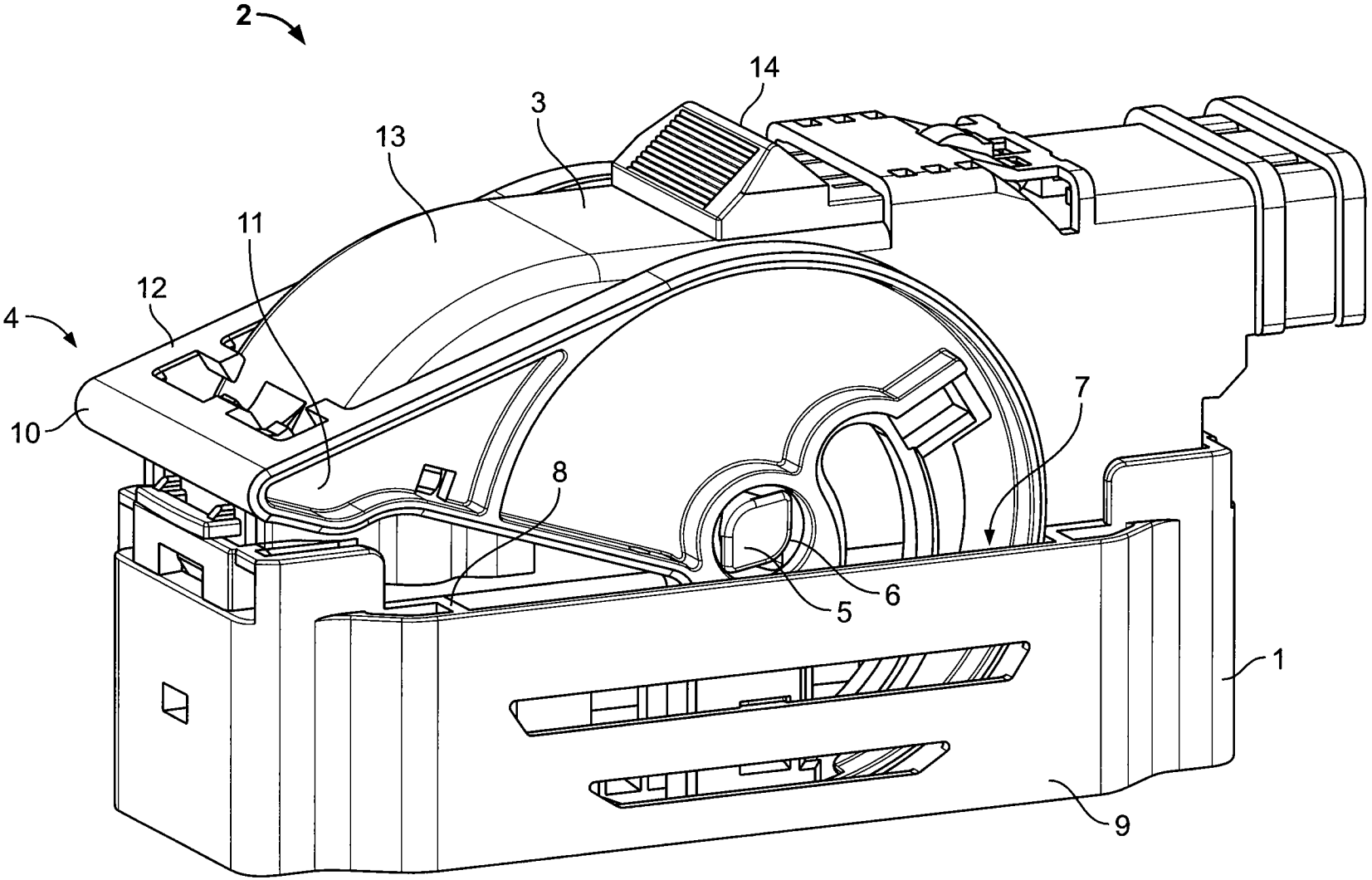
FIG. 1: a perspective view of a casing of a plug-in connector.

FIG. 1 shows a perspective view of a casing 1 of a plug-in connector 2 with a covering cap 3, with a U-shaped lever 4 being fastened rotatably to the covering cap 3 on the covering cap 3. The covering cap forms part of the casing. The covering cap 3 in addition has one journal 5 in each case on the opposing long sides, which journals project into recesses 6 in the lever 4 and mount the lever 4 rotatably on the casing 1. A safety catch 14 is displaceably mounted on an upper side 13 of the covering cap 3. The covering cap 3 is connected to the casing 1 via latch connections. The casing 1 has one receiving space 7 in each case on opposing long sides, which space is formed between one inner wall 8 and one outer wall 9 of the casing 1 in each case.

The lever 4 is formed as a U-shaped lever with a connecting piece 10 and two lever arms 11, 12 arranged in parallel. An axis of rotation of the lever 4 which is defined by the journals 5 and the recesses 6 is arranged spaced apart from free ends of the lever arms 11, 12. FIG. 1 shows the lever 4 in a pre-assembly position. The receiving spaces 7 are formed such that the free ends of the lever arms 11, 12 are arranged in the receiving spaces 7 and the free ends of the lever arms 11, 12 receiving spaces 7 can be moved upon pivoting of the lever 4 in the receiving spaces.

Figure 2:
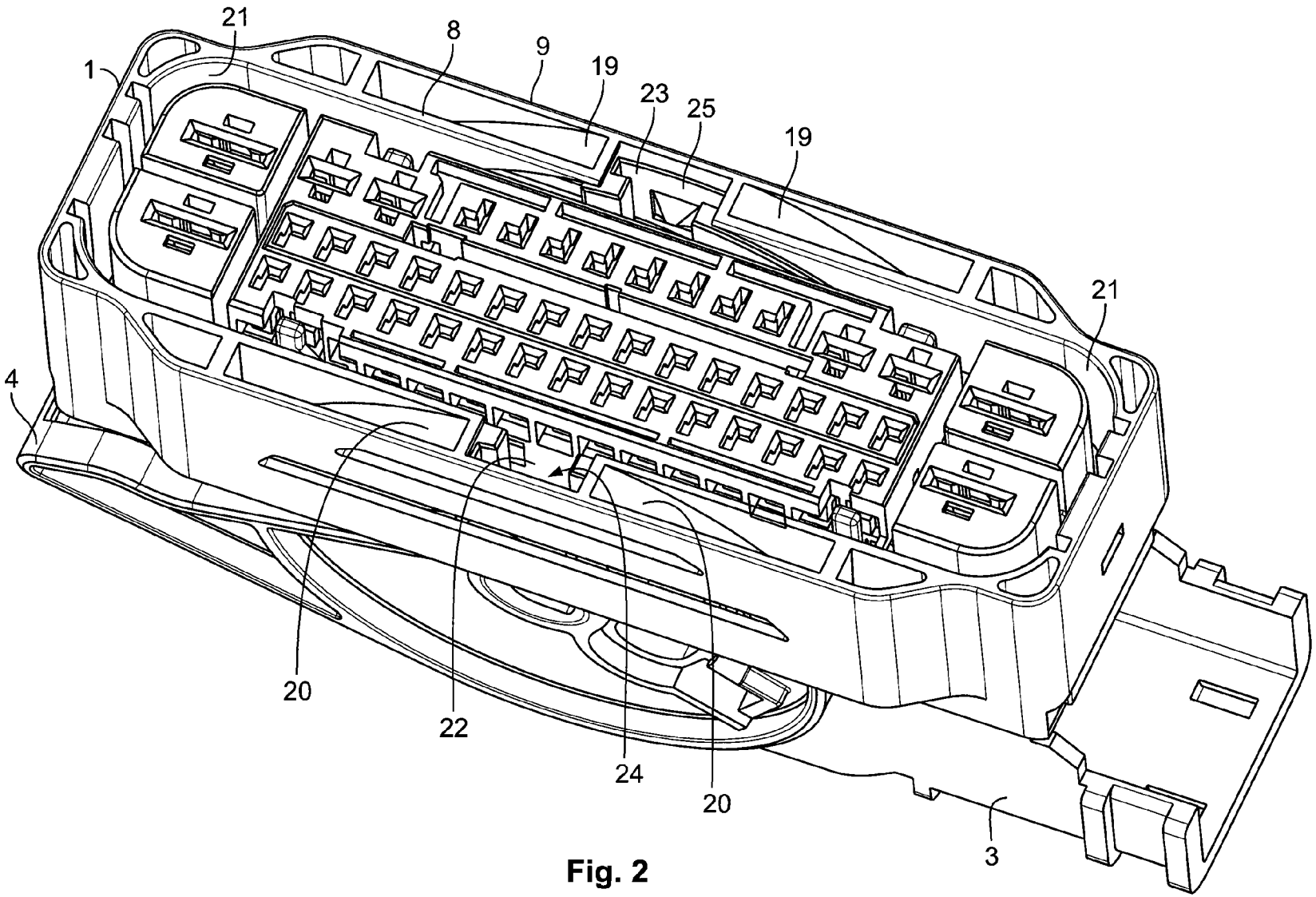
FIG. 2: the casing from below.

FIG. 2 shows the casing 1 of the plug-in connector 2 from the underside. A contact casing 15 is inserted in the casing 1, in which casing contact chambers for receiving electrical contacts, for example sockets or pins, are formed. The contact casing 15 is arranged between the two inner walls 8, 16. In each case the receiving spaces 7, 18 are formed between the inner walls 8, 16 and the outer walls 9, 17. In the example of embodiment illustrated, the receiving spaces 7, 18 are covered by means of one guide contour 19, 20 in each case. A circumambient third receiving space 21 is formed between the contact casing 15 and the inner walls of the casing 1. The inner walls 8, 16 have slot-shaped recesses 22, 23 which are oriented parallel to a direction of insertion and hence perpendicular to the underside of the contact casing 15 which is illustrated. Insertion spaces 24, 25 for receiving guide journals as guide elements of a second casing are provided in the region of the first and the second recess 22, 23.

Figure 3:
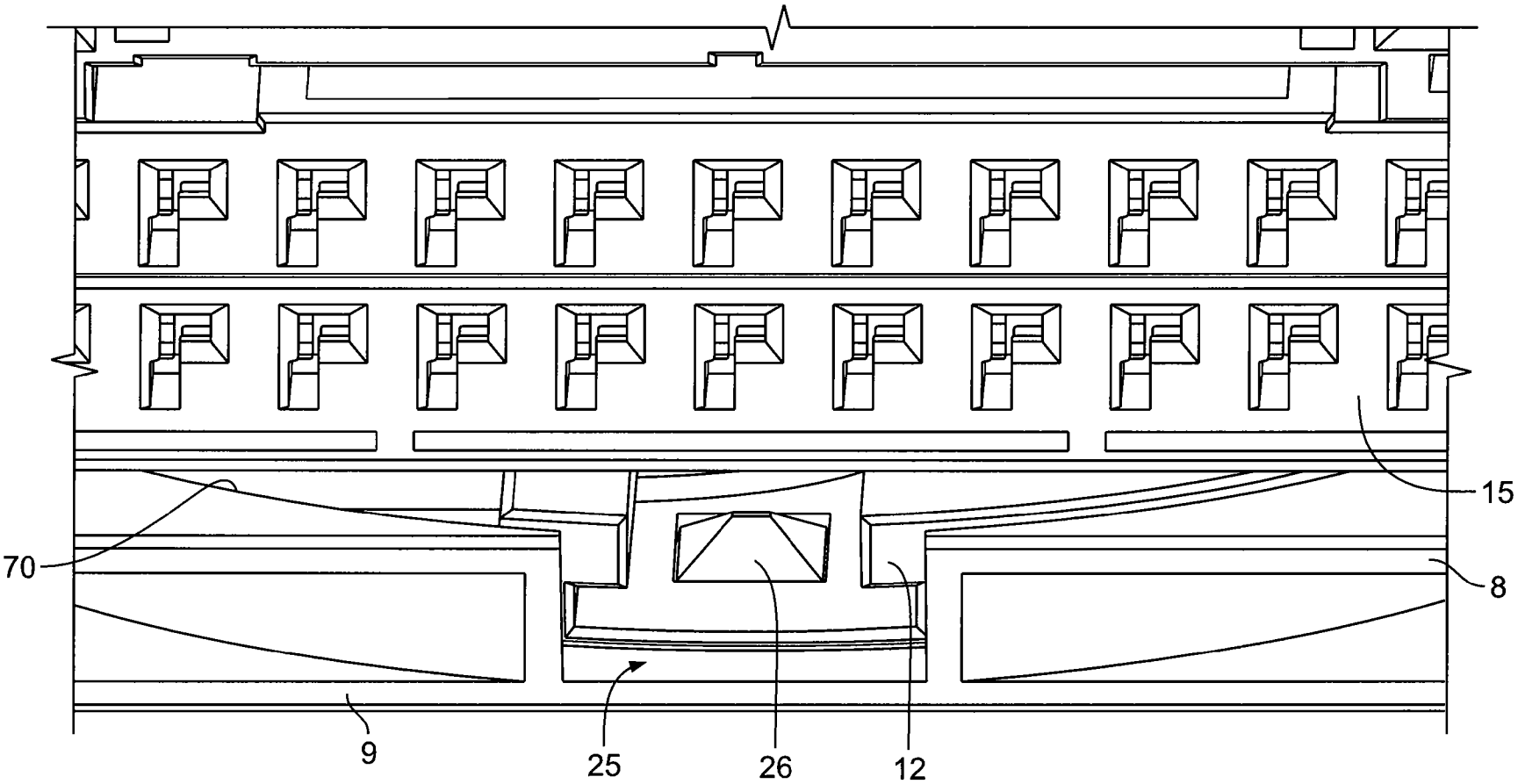
FIG. 3: a section view of an insertion opening for a guide element with blocking element.

FIG. 3 shows, in an enlarged partial view, an insertion space 25, the insertion space 25 being arranged between an inner side of a lever arm 12 of the lever 4 and an inner region of the casing 1, which region is formed by a wall 70 of the contact casing 15. A first blocking element 26 projects into the insertion space 25 through a passage in the lever arm 12, which represents a latch recess 37. The first blocking element 26 is formed on an inner side of the outer wall 9 of the casing 1. In this manner, the lever 4 is blocked in the pre-assembly position and cannot be pivoted into an end position. In a simple embodiment, the blocking element is guided laterally past the lever arm 12, so that no latch recess is necessary.

Figure 4:
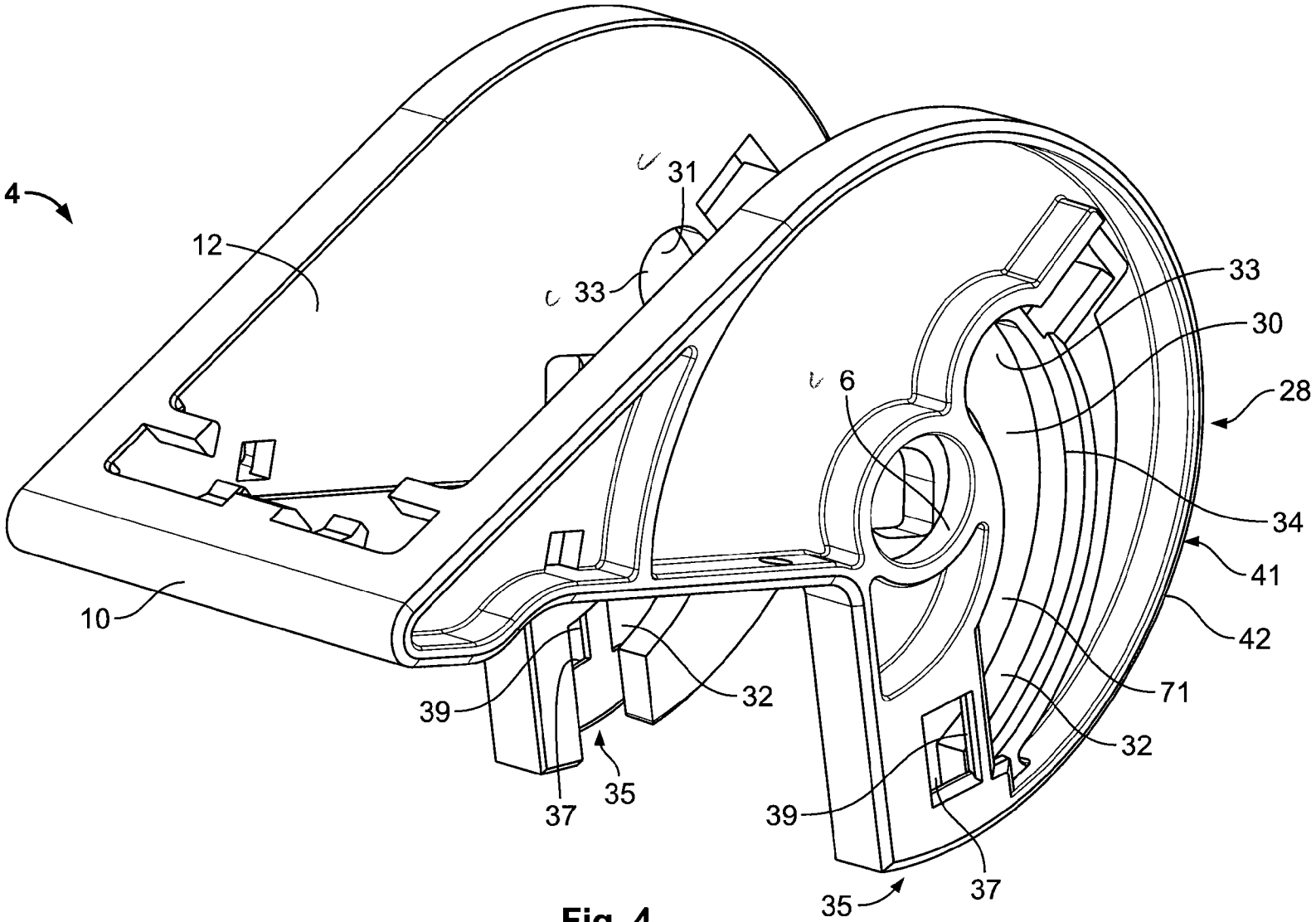
FIG. 4: a lever.

FIG. 4 shows the lever 4 in a perspective view. The lever arms 11, 12 of the lever 4 are formed mirror-symmetrically to a centre line. Explanations given with respect to one lever arm 11, 12 apply correspondingly with symmetrical geometry to the other lever arm as well. Departing from the connecting piece 10, the lever arms 11, 12 widen in the direction of the recesses 6 in the direction perpendicular to the longitudinal extent of the lever arms 11, 12. Free ends of the lever arms 11, 12 merge into guide sections 28, 29. The guide sections are plate-shaped and have approximately the shape of a quadrant. The respective guide section 28, 29 has in each case a guide track 30, 31 in the form of a recess. The guide tracks 30, 31 serve to receive guide journals. The guide tracks 30, 31 have the form of a circular path, the centre point of the circle being arranged offset to the recess 6. In this manner, upon pivoting of the lever 4 from the pre-assembly position into an end position, the guide journal is pulled upwards in the direction of the axis of rotation of the lever 4, the guide journal sliding from an entry region 32 to an end region 33 of the guide track 30, 31. The guide tracks 30, 31 have a guide bar 34 on a radially outer side.

In addition, the lever arms 11, 12 have in the region of the entry region 32 in each case on an inner side a third recess 35 which is carried in each case up to a radially inner side 71 of the guide track 30, 31. In this manner, the third recess 35 represents part of an insertion space via which a guide journal can be inserted into the first or second guide track 30, 32. The entry region 32 of the guide tracks 30, 31 adjoins the third recesses 35. In the region of the third recesses 35, the guide sections 28, 29 have in each case a latch recess 37. The latch recesses 37 are rectangular in the example of embodiment illustrated. Depending on the embodiment selected, the latch recess 37 may also be laterally opened and for example be only in the form of a lateral blocking surface 39 which is arranged perpendicular to the direction of rotation of the guide section 28, 29. The guide sections 28, 29 have on an end face 41 a second guide contour 42 which is in the form of part of a circle. The centre point of the radius of the second guide contour 42 is arranged in the axis of rotation of the lever 4.

Figure 5:
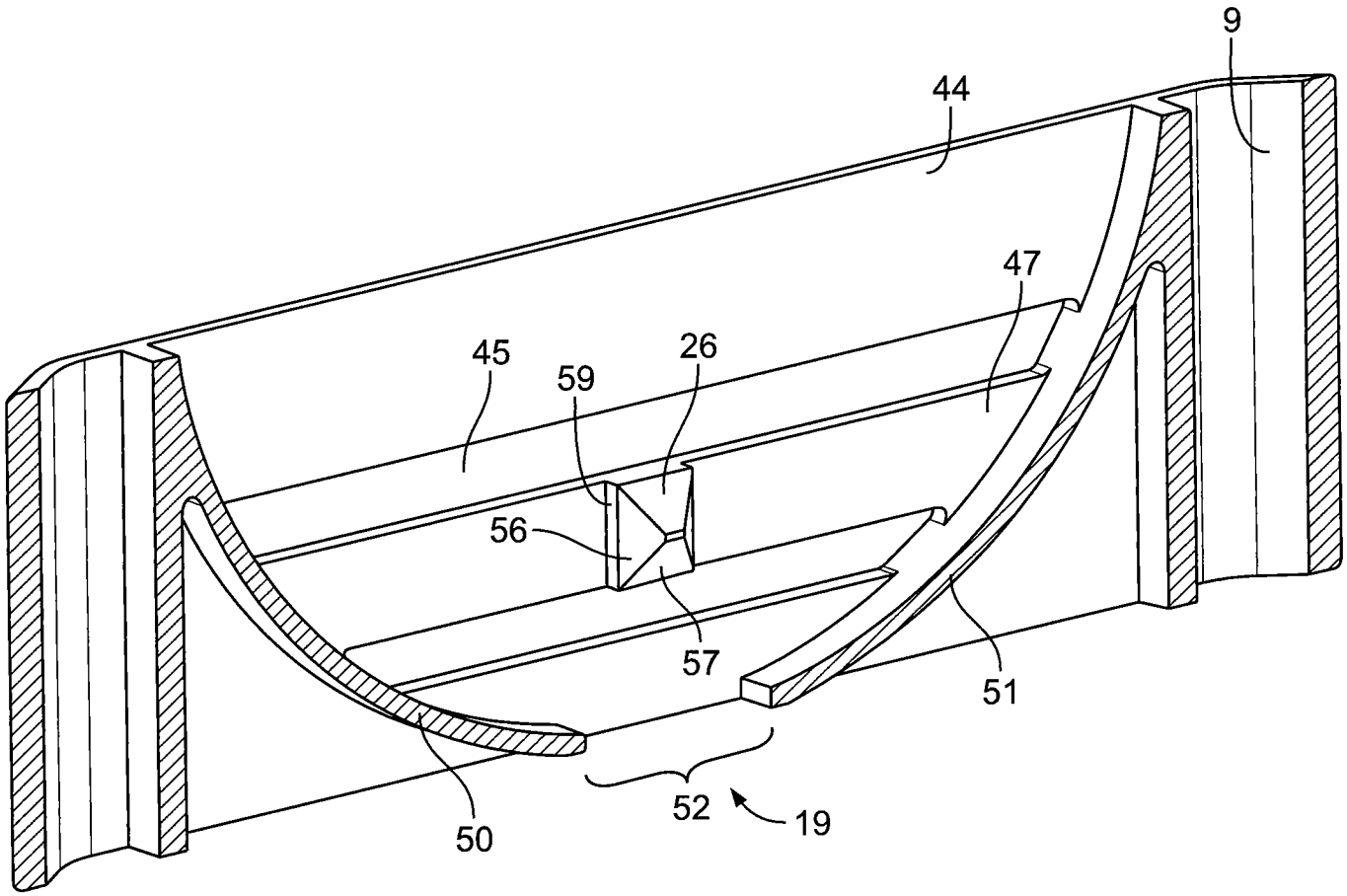
FIG. 5: a partial view of an inner side of an outer wall of the casing.

FIG. 5 shows a partial view of an inner side 44 of the outer wall 9. The outer wall 9 has a fourth and a fifth recess 45, 46 which are formed parallel to each other, with a flexible element in the form of a wall section 47 being shown between the recesses 45, 46. The first blocking element 26, which is directed inwards, is formed on an inner side of the wall section 47. The wall section 47 is formed as a narrow strip, and is thus elastically movable outwards. Furthermore, the first guide contour 19 is formed on the inner side 44, which contour is embodied in the form of two bars 50, 51. The two bars 50, 51 are in the form of a circular edge formed symmetrically to a centre line of the inner side 44, the centre line running through the first blocking element 26. Beneath the first blocking element 26, the two bars 50, 51 are spaced apart from each other, so that an introduction opening 52 for the guide journals of the second casing is provided. The spacing between the ends of the first and the second bar 50, 51 which face each other is greater than the width of a guide journal.

Figure 6:
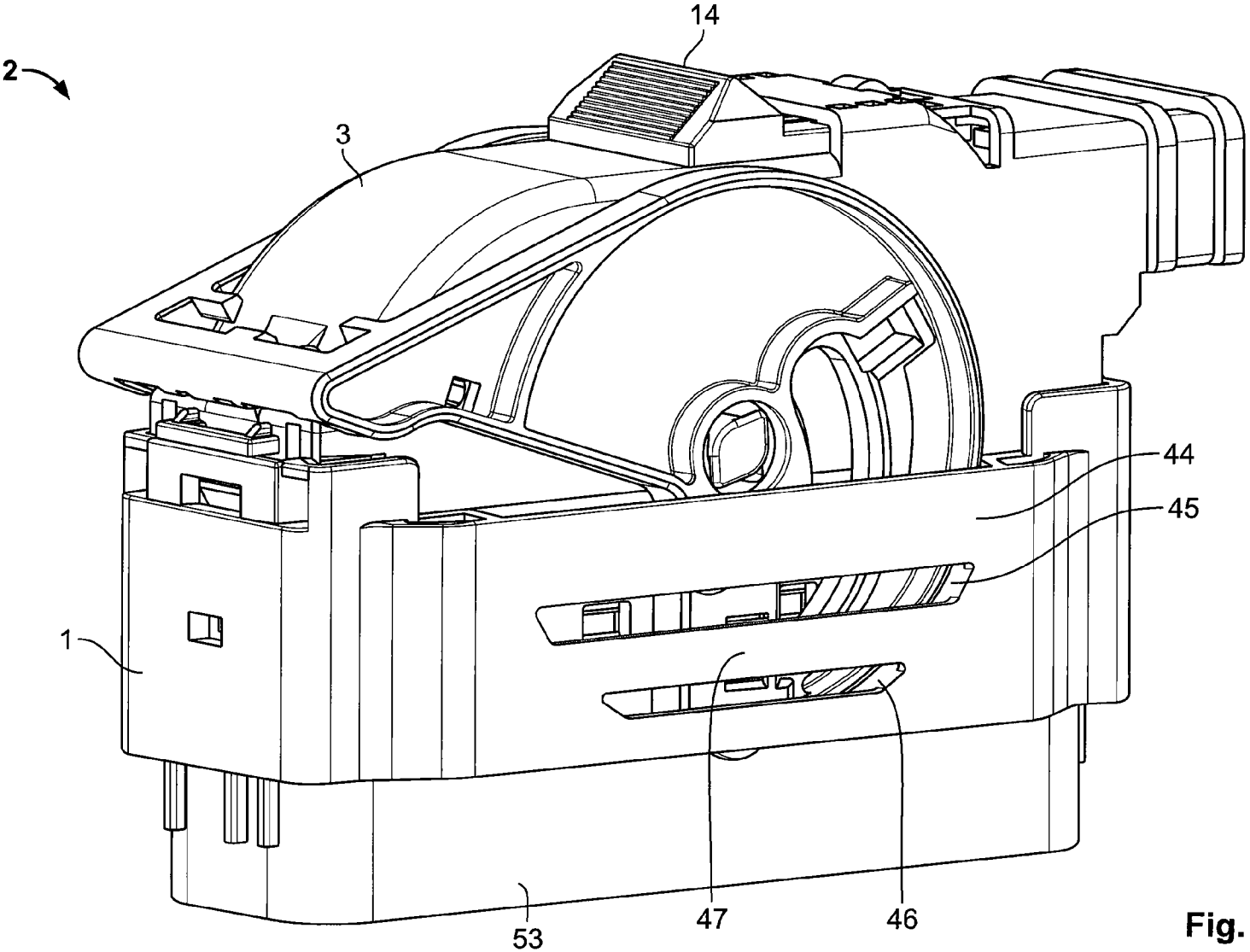
FIG. 6: the plug-in connector with a second casing inserted in a pre-assembly position.

FIG. 6 shows the electrical plug-in connector 2 with the casing 1, into which casing a second casing 53 is inserted from below. The second casing 53 likewise has a contact casing with recesses for contacts in the form of sockets or pins. In addition, the second casing 53 has a circumambient edge which projects beyond an insertion side of the second contact casing. Furthermore, the second casing has on opposing side faces outwards-projecting guide journals 54, 55 as guide elements, as illustrated in FIG. 7.

Figure 7:
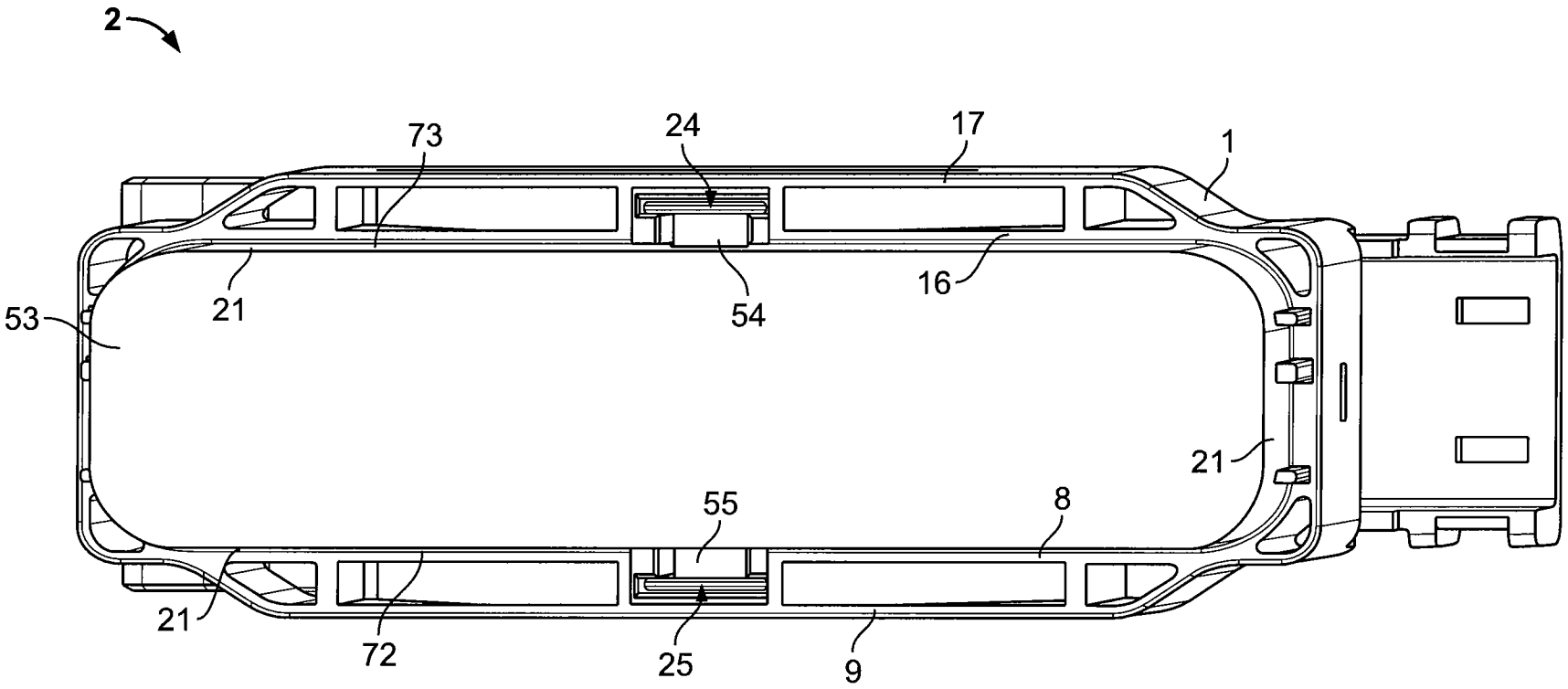
FIG. 7: a cross-section through the arrangement of FIG. 6 in the region of the second casing with a view of the guide elements.

FIG. 7 shows a cross-section through the first and the second casing, somewhat below the guide journals 54, 55. The circumambient edge of the second casing 53 is inserted into the circumambient third receiving space 21 of the first casing. Upon insertion, the guide journals 54, 55 are inserted via the insertion spaces 24, 25 into the starting regions of the guide tracks 30, 31. The guide journals 54, 55 in this case project so far laterally beyond the side walls 72, 73 of the second casing 53 that upon insertion of the guide journals 52, 53 into the third recesses 35 of the guide sections 28, 29 the blocking elements 26 are pushed away outwards, as is indicated diagrammatically in the form of arrows.

Figure 8A:
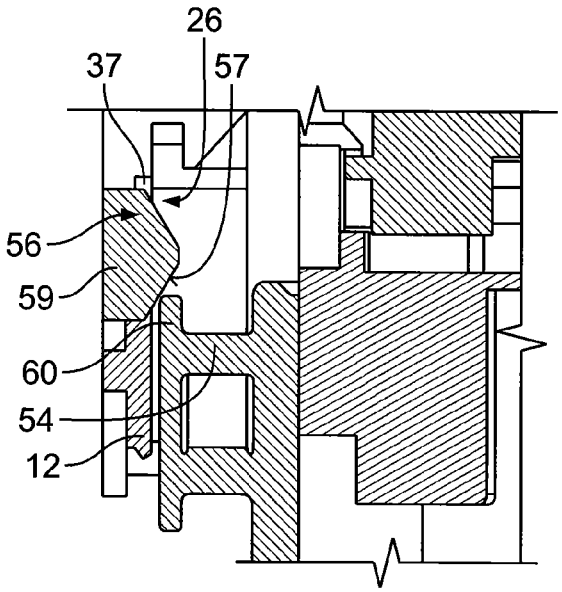
FIGS. 8A to 8C show diagrammatic cross-sections through the plug-in connector.

FIG. 8A shows in a partial view of a cross-section along a direction of insertion of the second casing 53 into the casing 1 and perpendicular to the plane of the guide sections 28, 29 in the region of the first blocking element 26, which upon introduction of the second casing 53 into the casing 1 is pushed away outwards by the first guide journal 54. In this case, it can clearly be recognised that the first blocking element 26 has an inclined actuating surface 57, across which the guide journal 54 slides and pushes the blocking element 26 outwards.

Figure 8B:
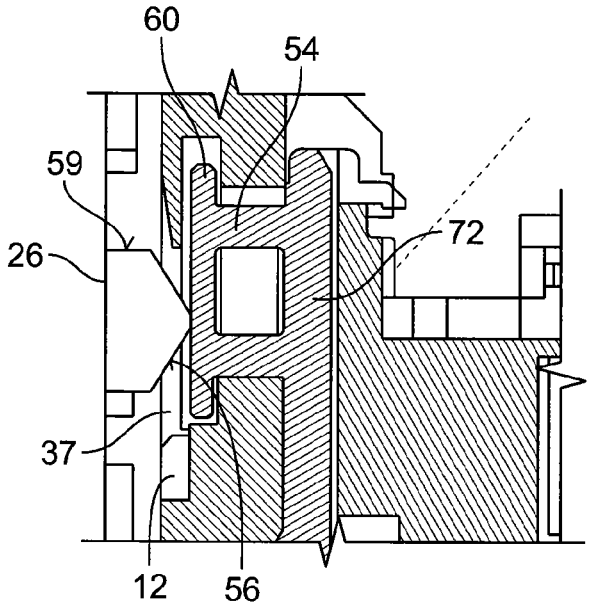

FIG. 8B shows a partial view of a cross-section perpendicular to the direction of insertion of the second casing 53 into the casing 1 and perpendicular to the plane of the guide sections 28, 29 in the region of the first blocking element 26, the second casing 53 being inserted so far into the casing 1 that the two casings 1, 53 are in the pre-assembly position and the blocking elements 26, 27 are in the release position. The first blocking element 26 has a second blocking surface 59 which in the rest state of the first blocking element 26 is associated with the blocking surface 39 of the first lever arm 11. The first blocking surface 39 and the second blocking surface 59 are arranged parallel to one another, so that any movement of the lever 4 is blocked. Due to the pushing-out of the first blocking element 26 by the guide journal 54, the second blocking surface 59 is moved outwards and a sliding surface 56 of the first blocking element is moved to the level of the first blocking surface 39 of the guide section 28. Thus movement of the lever out of the latch position is permitted. FIG. 8B shows the first blocking element 26 in this release position. In the release position, the second blocking surface 59 is displaced outwards and a sliding surface 56 is associated with the blocking surface 39. The sliding surface 56 is arranged inclined in the pivoting direction of the lever arm and hence in the direction of movement of the first blocking surface 39, so that the first blocking surface 39 upon pivoting of the lever 4 slides on the sliding surface 56 and in so doing pushes the first blocking element 26 still further outwards.

Figure 9:
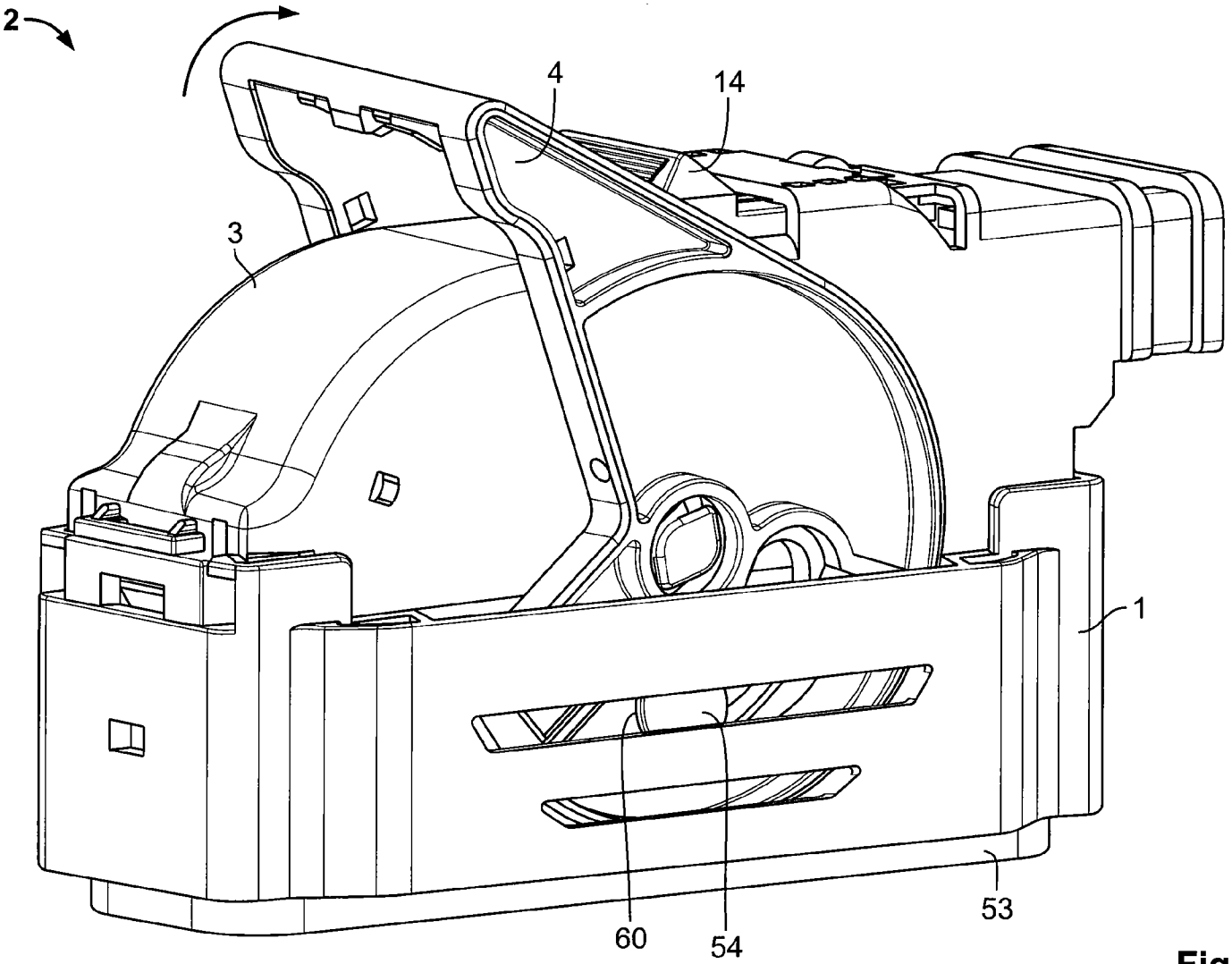
FIG. 9: the plug-in connector with a lever in an intermediate position.

If then the lever, as illustrated in FIG. 9, is pivoted from the pre-assembly position shown in FIG. 7 by rotation (arrow) in the direction of an end position, first the first blocking element 26 is pushed completely out of the latch recess 37 of the guide section 28, 29 by the movement of the lever. This is possible owing to the sliding surface 56 on the first blocking element. In addition, by pivoting the lever 4 the guide tracks 24, 25 are moved in a clockwise direction and a widened edge region 60 of the guide journals 54, 55 is engaged underneath by the guide bars 34 of the guide tracks 30, 31. In this manner, the guide journals 54, 55 upon further pivoting are moved upwards in the direction of the axis of rotation of the lever 4 and thus the second casing 53 is pulled closer to the first casing 1. Upon the pulling together, the electrical contacts of the two casings 1, 53 are contacted with each other. Upon pivoting the lever 4, the second guide contours 42 of the guide sections 28, 29 of the lever 4 slide on radially inner surfaces of the bars 50, 51 of the outer walls 9, 17. This provides support of a rotation set about the axis of rotation. This places less stress on the rotary mounting.

Figure 8C:
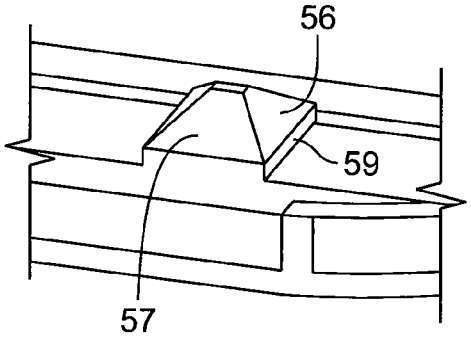

FIG. 8C shows a perspective view of the first blocking element 26 with the second blocking surface 59, the sliding surface 56 and the actuating surface 57. The second blocking element 27 is formed identically and the method of operation is identical to that of the first blocking element 26.

Figure 10:
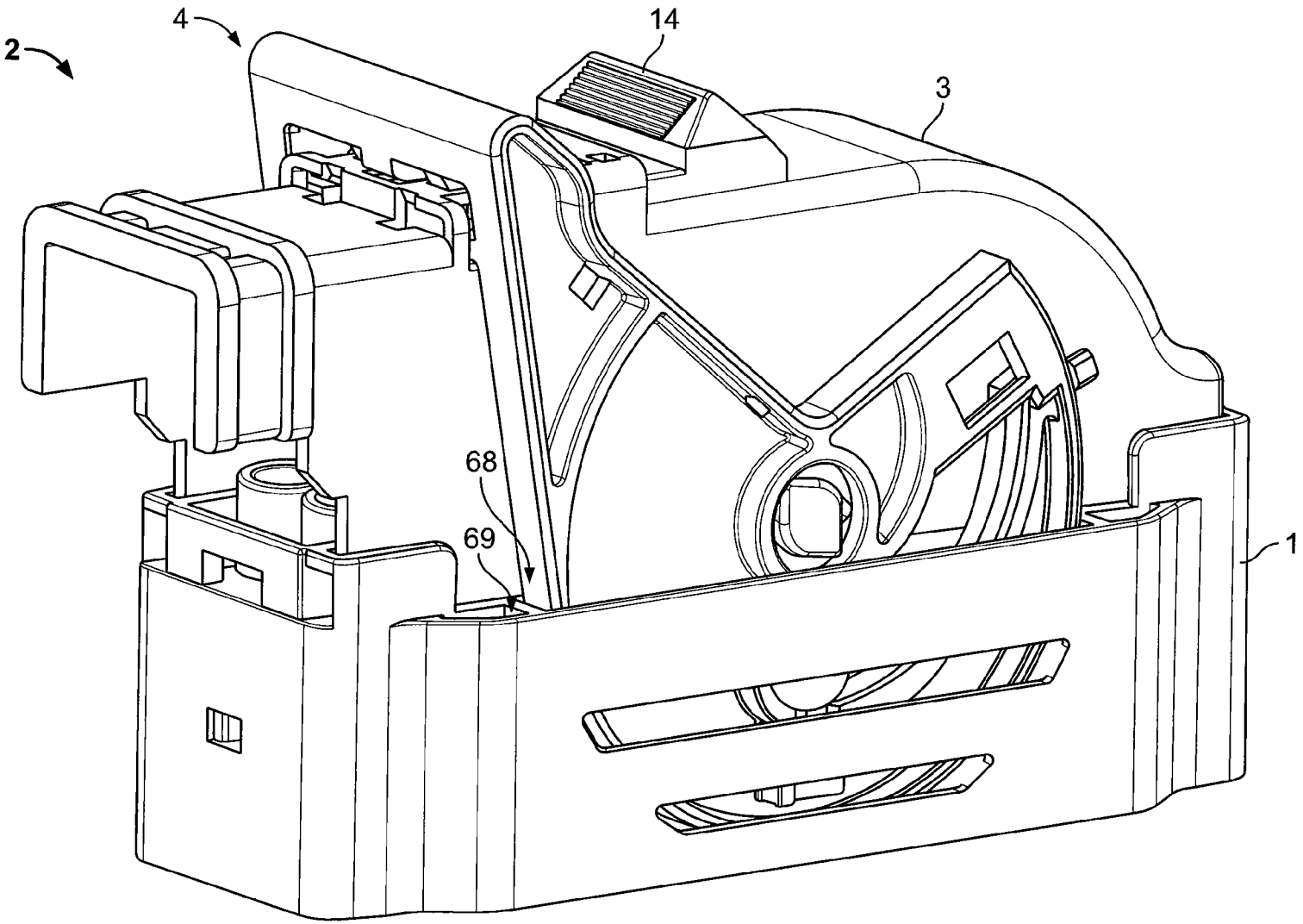
FIG. 10: the plug-in connector with a lever in an end position.

FIG. 10 shows a partial view of the plug-in connector 2 with the lever 4 in the end position, in which the two casings 1, 53 are completely fitted together and the electrical contacts (not visible) of the two casings are in contact with each other. The pivoting angle of the lever 4 in an anticlockwise direction is limited in that the lever 4 hits with an outer contour 68 in the region of a contact surface 69 of the casing 1.

Figure 11:
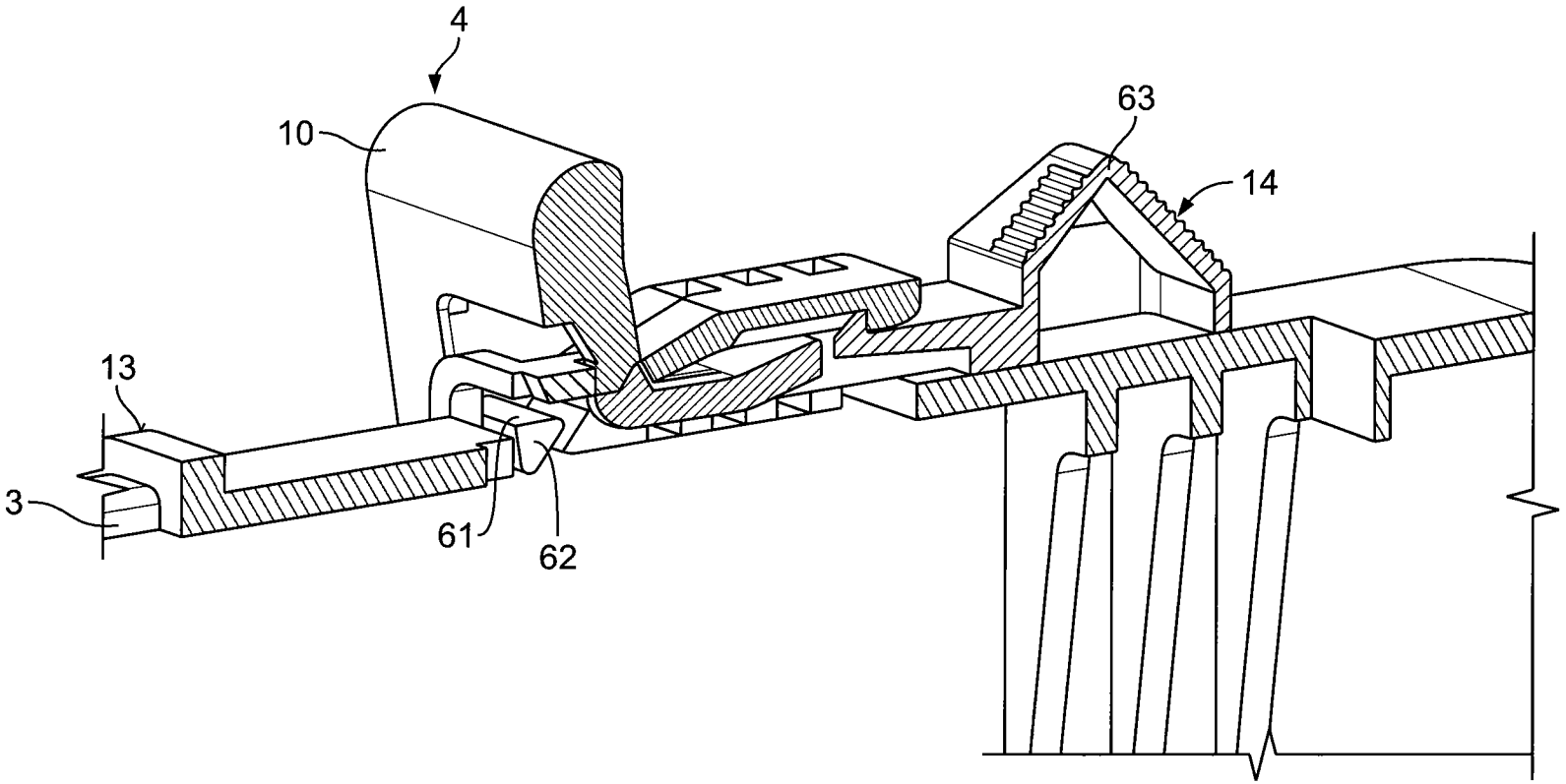
FIG. 11: a partial cross-section through the lever in the end position and through a safety catch.

FIG. 11 shows in a partial view a cross-section through the connecting piece 10 and the safety catch 14. The safety catch 14 has two lateral horizontal faces 61 which can be pushed under a cam 62 of the lever 4, the cam 62 being formed on the inner side of the lever 4. The safety catch 14 in addition has an operating element 63 which serves for easier actuation by hand. In addition, the safety catch 14 on an underside is displaceably guided along the upper side 13 of the covering cap 3 in lateral grooves 64 in the covering cap 3.

Figure 12:
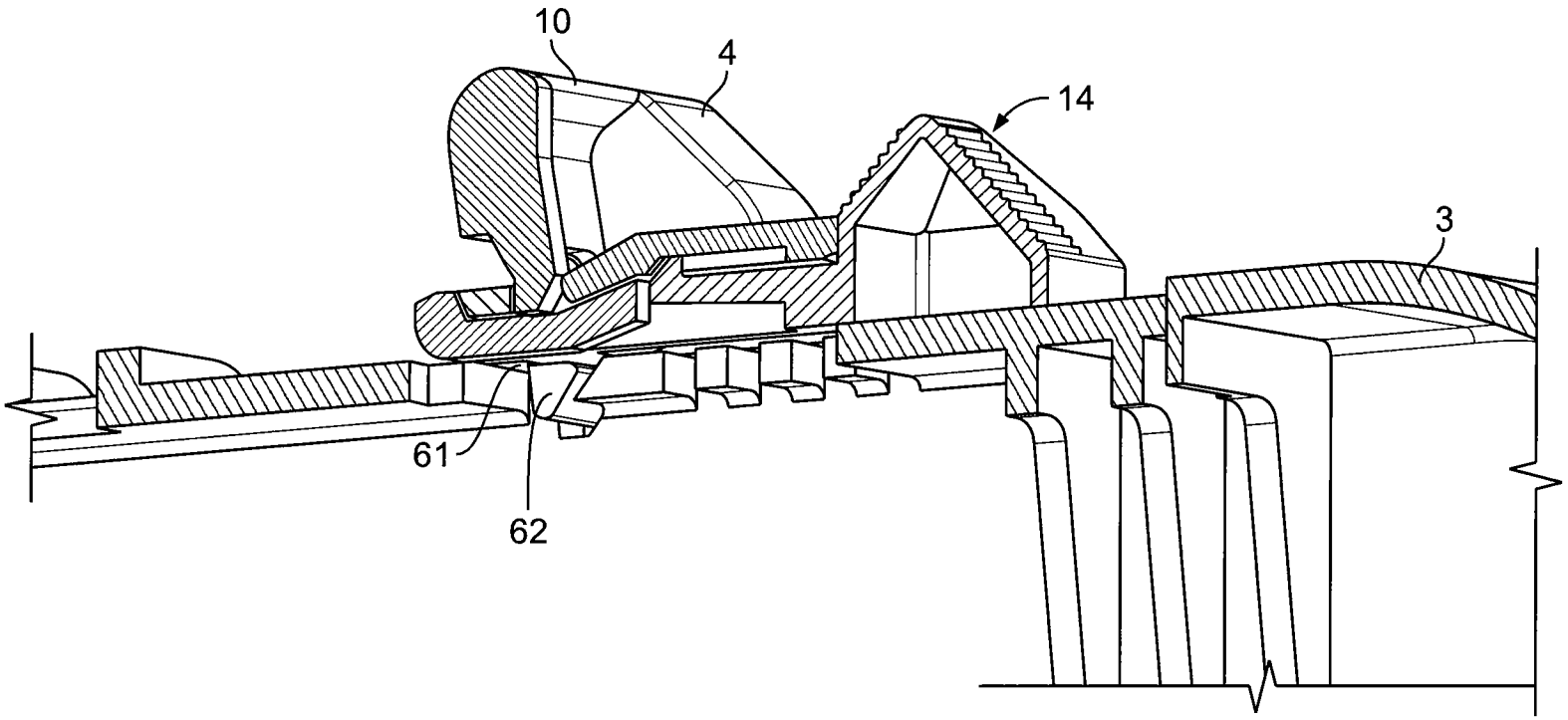
FIG. 12: a partial view of the electrical plug-in connector with a lever in the end position and the safety catch in a blocking position.

FIG. 12 shows in a perspective partial view the safety catch 14 in a latching position in which the horizontal face 61 is pushed beneath the cam 62 and thus holds the lever 4 securely in the end position.

Figure 13:
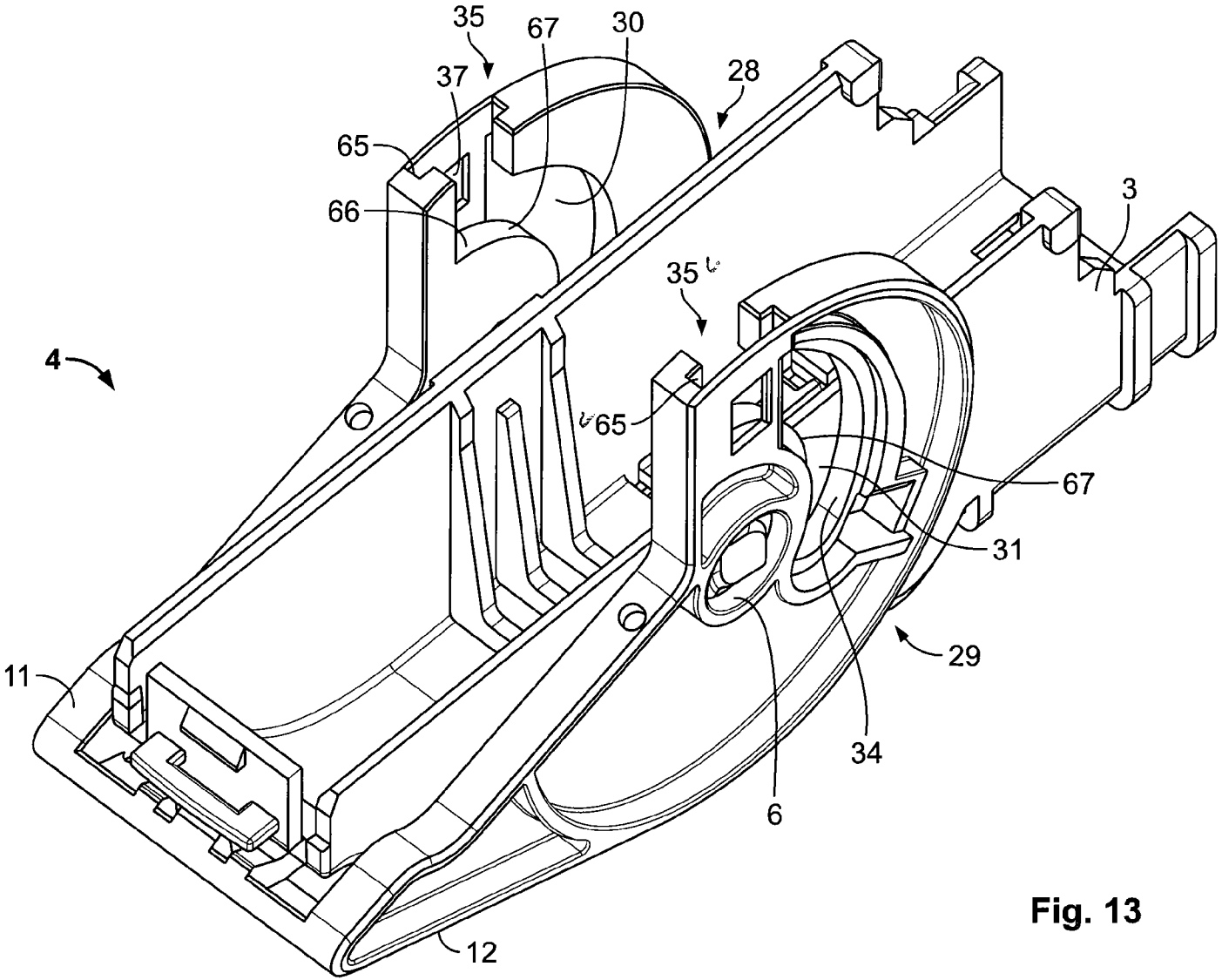
FIG. 13: the casing of FIG. 1 from below.

FIG. 13 shows the lever 4 with the covering cap 3 from the underside. The guide sections 28, 29 have in the region of the third recess 35 in each case a guide groove 65 which serves for receiving the widened edge 60 of the guide journal. The guide journals are guided by the guide groove 65 in the direction of a second contact surface 66 which is arranged between the latch recess 37 and the pivot point. In addition, a second guide bar 67 is also formed on a radial inner side of the guide tracks 30, 31, which bar engages beneath the widened edge 60 of the guide journal on a radial inner side. It can clearly be seen in FIG. 13 that the guide bars 34, 67 adjoin the insertion space and upon pivoting of the lever 4 engage beneath the widening edges 60 of the guide journals 54, 55.

Thus the guide journals upon pivoting of the lever are guided accurately on a radial inner side and on a radial outer side by the guide bars 34, 67 which are arranged in parallel.

The invention claimed is:

1. An electrical plug-in connector with a casing, with a lever rotatably mounted on the casing, the lever having a guideway, the guideway being provided for guiding a guide element of a second casing, with the guide element being guided in the guideway upon rotation of the lever and the second casing being pulled from a pre-assembly position with regard to the casing into an end position, the casing having a flexible blocking element, an insertion space for introducing the guide element into the guideway being provided, the blocking element having an actuating surface, the actuating surface in a rest position of the blocking element projecting into the insertion space, the lever having a blocking surface, the blocking element having a second blocking surface, with, in a rest position of the lever and in a rest position of the blocking element, the second blocking surface of the blocking element being associated with the blocking surface of the lever and blocking a movement of the lever from the rest position into an end position, the blocking element being formed such that the guide element upon introduction of the second casing into the pre-assembly position in relation to the casing being guided into the insertion space and in so doing the guide element acting on the actuating surface such that the blocking element is moved into a release position, so that the position of the second blocking surface of the blocking element relative to the blocking surface of the lever is changed such that the lever is released for a movement into the end position.

2. A plug-in connector according to claim 1, wherein the lever is arranged between an inner region of the casing and the blocking element, the insertion space being provided between the inner region of the casing and the lever, the blocking element being guided past the blocking surface of the lever, and the actuating surface being arranged between the lever and the inner region of the casing in the rest position of the blocking element and the lever.

3. A plug-in connector according to claim 2, further comprising a casing wall having on the inner side a first guide contour in the form of a partial circle, the lever having a second guide contour in the form of a partial circle, the first and the second guide contour being associated with each other and the first guide contour guiding the second guide contour on at least one partial circular path.

4. A plug-in connector according to claim 3, wherein the lever has on an outer side a recess in which the blocking element is arranged upon the movement of the lever from the latching position into the end position.

5. A plug-in connector according to claim 4, wherein the blocking element adjoins the second blocking surface having a sliding surface which is arranged inclined, the sliding surface and the second blocking surface being arranged such that in the rest position of the blocking element and of the lever the second blocking surface of the blocking element is associated with the blocking surface of the lever, and in the release position of the blocking element the sliding surface being associated with the blocking surface of the lever, so that the lever can be moved with low force from the latching position into the end position, the blocking surface of the lever sliding across the sliding surface and pushing the blocking element away from the blocking surface of the lever.

6. A plug-in connector according to claim 1, wherein the blocking element being designed as part of a flexible outer wall of the casing.

7. A plug-in connector according to claim 1, wherein the actuating surface of the blocking element is arranged inclined to the direction of movement of the guide element upon introduction into the insertion space, which facilitates deflection of the blocking element by the guide element.

8. A plug-in connector according to claim 1, wherein the lever has a latch recess, the blocking surface being formed on an inner side of the latch recess, and the blocking element in the rest position being guided through the latch recess.

9. A plug-in connector according to claim 1, further comprising a safety catch being movably mounted on the casing, the safety catch being movable into a blocking position, the safety catch in the blocking position holding the lever securely in the end position.

10. A plug-in connector according to claim 9, wherein the safety catch is displaceably mounted on the casing via a sliding guide and having a projection which holds the lever securely in the end position.

* * * * *